US006370835B1

(12) United States Patent
Morgan et al.

(10) Patent No.: US 6,370,835 B1
(45) Date of Patent: Apr. 16, 2002

(54) METHOD AND APPARATUS FOR LOW COST HOUSING CONSTRUCTION

(75) Inventors: James Robert Morgan, Johannesburg (ZA); Art Bond, Plantation; John Poffenbarger, Coral Springs, both of FL (US)

(73) Assignee: Robust Building Systems, Inc., Plantation, FL (US)

( * ) Notice: Subject to any disclaimer, the term of this patent is extended or adjusted under 35 U.S.C. 154(b) by 0 days.

(21) Appl. No.: 09/334,042

(22) Filed: Jun. 15, 1999

(51) Int. Cl.[7] ..... E04B 1/00

(52) U.S. Cl. ..... 52/745.05; 52/79.1; 52/92.1; 52/745.08

(58) Field of Search ..... 52/741.1, 745.02, 52/745.05, 745.08, 745.13, 745.19, DIG. 1, 79.1, 79.11, 79.12, 92.1, 93.1

(56) References Cited

U.S. PATENT DOCUMENTS

| | | | | |
|---|---|---|---|---|
| 1,530,662 A | | 3/1925 | Gibbons et al. | |
| 2,184,353 A | | 12/1939 | Leary | |
| 3,304,685 A | | 2/1967 | Whetstone | |
| 3,578,732 A | | 5/1971 | Lount et al. | |
| 4,052,829 A | | 10/1977 | Chapman | |
| 4,253,288 A | | 3/1981 | Chun | |
| 4,327,529 A | * | 5/1982 | Bigelow, Jr. et al. | 52/34 |
| 4,443,992 A | * | 4/1984 | Shechter | 52/745.02 |
| 4,559,752 A | | 12/1985 | Kieffer | |
| 5,081,814 A | | 1/1992 | Singletary et al. | |
| 5,157,887 A | | 10/1992 | Watterworth, III | |
| 5,375,381 A | * | 12/1994 | Park et al. | 52/92.1 |
| 5,381,633 A | * | 1/1995 | Hendrich | 52/71 |
| 5,487,242 A | * | 1/1996 | Stafford | 52/86 |
| 5,697,195 A | | 12/1997 | Maylon | |
| 6,073,404 A | * | 6/2000 | Norfleet | 52/236.3 |

FOREIGN PATENT DOCUMENTS

| | | |
|---|---|---|
| ZA | 94/5756 | 8/1994 |
| ZA | 95/6728 | 8/1995 |
| ZA | 96/2092 | 3/1996 |

* cited by examiner

*Primary Examiner*—Carl D. Friedman
*Assistant Examiner*—Jennifer I. Thissell
(74) *Attorney, Agent, or Firm*—Malloy & Malloy, P.A.

(57) ABSTRACT

A method and apparatus for field erection of structures, particularly residential buildings, adapted to utilization of locally available labor and having a significant content of locally available materials. A rectangular floor covering sheet serves both as a waterproof sub-floor and as a layout template for erection of the building framework and the tools used serve as the measuring means required for all dimensions to be determined on-site. Temporary horizontal side beams and permanently installed roof beams are positioned and braced by diagonal and horizontal wire members, while vertically folded, expanded metal mesh reinforcing members provide lath surfaces for application of hardening filler material for walls, so as to provide a substantially monolithic steel-reinforced basic building structure.

32 Claims, 12 Drawing Sheets

METHOD AND APPARATUS FOR LOW COST HOUSING CONSTRUCTION

TECHNICAL FIELD

The present invention relates to the general field of low cost rectangular structures and more particularly, to a packaged kit adapted to use along with locally available materials and local, unskilled labor for such construction.

BACKGROUND OF THE INVENTIONS

In every emerging Third World country, government and industry conspire to encourage economic development through housing and training of their citizens. The realities of Third World economics are such that the vast majority of these people will be without formal skills and will be living at a subsistence level. A great number of housing units will generally be required and these units must be extremely low in cost in order to be available in the necessary quantity, yet quality cannot be sacrificed. Solid masonry construction is preferred in the third world. Construction methods should be simple so as to be within the capabilities of local labor and reduce the need for expensive supervision and local materials should be used wherever possible so as to promote acceptance in local markets.

Over the years, this need has been recognized and addressed by others in a variety of designs and construction methods. In essence, these prior art designs and methods can be categorized as "steel reinforced cementitious construction."

In U.S. Pat. No. 1,530,662, Sherwin Gibbons and Herman Hensel disclose a wall construction comprising two pieces of expanded metal mesh (lath) connected to opposite faces of studs and restrained by hook members from bulging when the internal spaces are packed with compacted soil. The external faces are then finished with cementitious plaster.

In U.S. Pat. No. 2,184,353, Marshall Leary discloses a relatively thin studless wall construction using two layers of metal lath separated by vertical, parallelly spaced rib members. Cementitious plaster applied to both outside surfaces is worked through the lath openings to fill the internal space.

In U.S. Pat. No. 3,304,685, William Whetstone discloses expanded metal core members which may be joined together and used for construction of studless walls.

The core members may be assembled in a back-to-back relationship, so as to leave open interstices for insulating purposes, and also include outwardly extending legs to serve to define a plane for leveling the outside surface of a plastic or cementitious filler material.

In U.S. Pat. No. 4,052,829, Ward Chapman discloses a building construction method using fabricated wall sections made of flat expanded metal panels rigidly supported by a permanent metal framework. The design of the wall sections may include doors, windows and size variations for different floor plans. Plaster may be applied to the outside only, or to both inside and outside according to the desired end use and budget of the end user.

In U.S. Pat. No. 4,253,288, Joo Chun discloses another type of wall panel section for building construction. Chun teaches a wall panel comprising an open welded wire framework, which includes backing panels. The wall panels are joined together in the field and insulating foam is sprayed in place against the backing panels, so that it expands in place to form a monolithic interior wall shape reinforced and supported by a framework of welded wire. Conventional wall covering materials are applied over wire members which extend through the backing.

In U.S. Pat. No. 4,559,752, Joseph Kieffer discloses a wall frame section, made of flat sheet metal, which is slit to form a monolithic, three dimensional frame section when expanded. Kieffer also teaches joining such frame sections together as a wall reinforcement structure by the use of a plurality of horizontal rods with end hooks to engage the vertical frame members.

All of the above art teaches innovative methods and structures for the construction of low cost housing as would be suitable to use in Third World scenarios. While this art recognizes the requirements of low cost, thermal insulation and function in general, none are adapted to address all of the somehow interrelated realities of providing housing to such countries. The nature of these Third World countries provides large numbers of inexpensive and largely unskilled laborers. Therefore, in the design of this housing, labor cost savings are less important than avoiding the need for scarce industrial skills such as welding and reading a tape measure.

Distribution of the required building materials and essential tools within the country must be considered as part of the total construction process. Therefore, it is desirable that the essential tools be either widely available or inexpensive and disposable.

The cement industry is often established early in the economic evolution of a Third World country and, in such a case, it will almost invariably be controlled by a dominant political entity. Therefore, from the market viewpoint, this housing design should emphasize the use of locally supplied concrete. If, on the other hand, the houses are to be built in a locale where concrete is unavailable, the design should permit the use of clay, mud or other alternative local material.

A first object of the present inventions therefore, is to provide building construction methods and designs that are inherently inexpensive. A second object of the present inventions is to provide building construction methods and designs that are not merely inexpensive, but also can be implemented in the absence of industrial skills and resources. A third object is that the present inventions be of a nature that is readily transported to and distributed within Third World countries. A fourth object is that the construction methods and designs of the present inventions be compatible with the usage of local materials wherever possible. A fifth object is to produce a finished structure that is similar in appearance to other local structures.

SUMMARY OF THE INVENTIONS

The present inventions contemplate improved methods and apparatus for facilitating the construction of low cost structures. Practice of the present inventions uses some steps and apparatus well known in the construction arts and therefore, not the subject of detailed discussion herein.

In a preferred embodiment of the present inventions, a kit for building one structure shell, including foundation, exterior walls, roof structure and roof covering is packaged separately. The construction kit includes all materials required to build a single complete structure, except for concrete or an alternative filler material. A separate kit contains tools and reusable parts for building of a group of structures. The tools and reusable parts kit comprises:

(a) shovel;

(b) wrench;

(c) plastering tools;

(d) hog-ring pliers;

(e) wire cutters;

(f) plastic tubing for a water level;

(g) stake driving tool;

(h) horizontal bracing members and attachment devices;

(i) diagonal squaring cables of adjustable length; and (j) pictorial instruction book.

The construction kit comprises the following materials:

(a) folded, rectangular, waterproof floor cover;

(b) four corner post assemblies;

(c) two temporary top beams for the house side-walls;

(d) roof truss components;

(e) accordion folded, expanded metal mesh wall reinforcement panels;

(f) door and window sub-frames;

(g) wires and tensioners for stretching between the corner posts to define interior and exterior wall surfaces;

(h) roof covering materials; and (i) miscellaneous hardware.

According to a preferred embodiment of the present inventions, an area somewhat larger than the length and width dimensions of the building is cleared and leveled at the proposed building site. A rectangular, waterproof floor covering sheet is then unfolded and stretched out on the leveled area. This floor cover serves a dual role in that it provides waterproof flooring and acts as a square, accurate layout template for the basic dimensions of the house. The shovel and stake driving tool furnished in the tool kit serve as the measuring means required for all dimensions to be determined on-site. Corner posts of uniform height are set at each corner of the level, rectangular floor. Temporary horizontal side beams and permanently installed roof beams are positioned and braced by turnbuckle diagonal braces of predetermined length so as to make the wall framing square and vertical. Horizontal wire members are placed to define the inner and outer wall construction surfaces and vertically folded, expanded metal mesh sheets are placed between these inner and outer construction surfaces to provide reinforcement. The expanded mesh also serves as lath for the application of locally supplied cementitious filler for the walls. In this manner, using unskilled local labor and available local materials, a relatively inexpensive, steel-reinforced building structure is provided.

BRIEF DESCRIPTION OF THE DRAWINGS

The accompanying drawings are incorporated into and form a part of the specification to assist in explaining the present inventions. The drawings illustrate preferred and alternative examples of how the inventions can be made and used and are not to be construed as limiting the inventions to only those examples illustrated and described. The various advantages and features of the present inventions will be apparent from a consideration of the drawings in which.

DETAILED DESCRIPTION OF THE DRAWINGS

Figure 1:
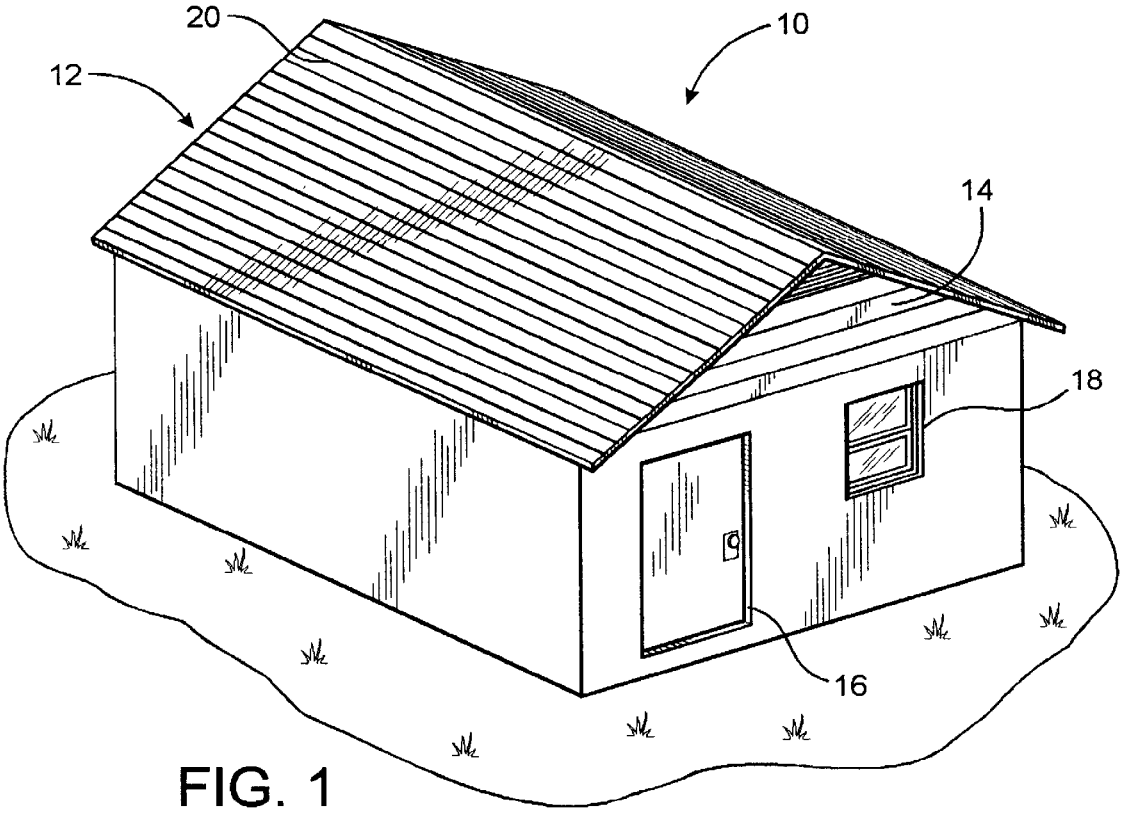
FIG. 1 shows a typical house constructed according to a preferred embodiment of the present inventions.

The embodiments shown above and described herein are exemplary. Many details are well known in the art, and as such are neither shown nor described. It is not claimed that all of the details, parts, elements, or steps described and shown were invented herein. Even though numerous characteristics and advantages of the present inventions have been described in the drawings and accompanying text, the description is illustrative only, and changes may be made in the detail, especially in matters of shape, size, and arrangement of the parts within the principles of the inventions to the full extent indicated by the broad general meaning of the terms used in the attached claims.

Figure 15:
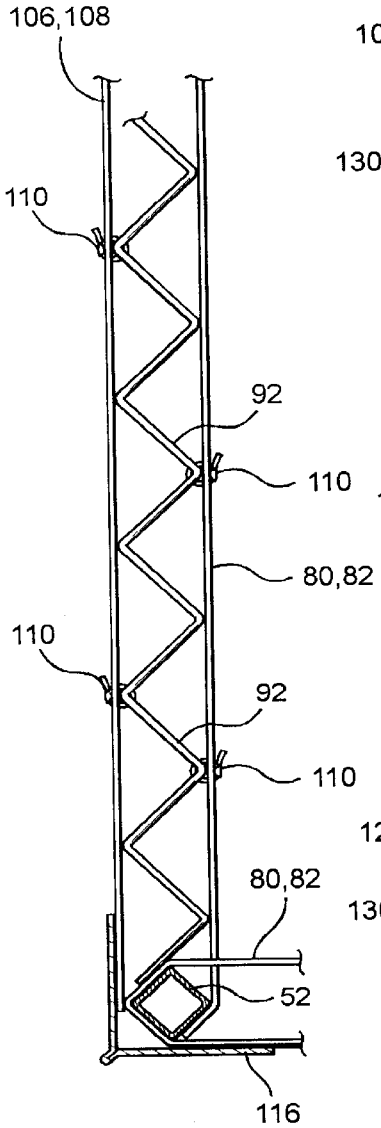
FIG. 15 is a section view of a wall constructed according to the present inventions as seen prior to application of a hardening filler material.
Figure 16:
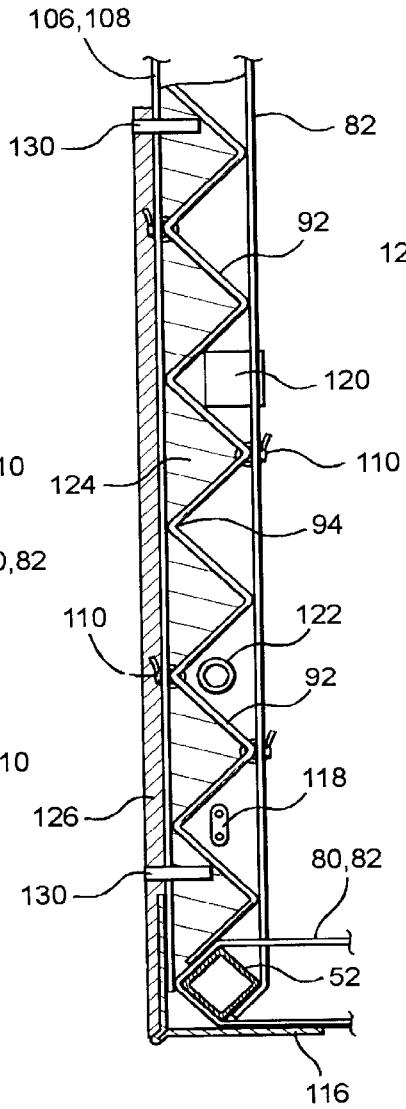
FIG. 16 is a section view of a wall constructed according to the present inventions as seen after installation of the optional plumbing pipes and fittings, electrical wires, switches and outlets and the application of a hardening filler material to the outer face of the metal mesh reinforcing members and a finished cover layer to the hardened filler material.

FIG. 1 is illustrative of a variety of forms of structure 10, which may be constructed according to preferred embodiments of the methods and apparatus of the present inventions. These methods and apparatus are not restrictive, so as to limit structure 10 to a given size or arrangement. The placement of door 16 and windows 18 can be at the discretion of the builder and the specifics of these items may be adapted as necessary to accommodate local manufacturing sources. The methods and apparatus of the present inventions permit the installation of a concrete floor (not shown) or any other type of floor, and the requisite pipes and wiring for utility services, as shown in FIGS. 15 and 16, as optional enhancements. Covered roof 12 may be made from metal roof covering products, clay or cement tiles, or overlapping fiber-cement panels 20. End gables 14 may be made from the same fiber-cement panels 20, spaced apart to afford ventilation, instead of overlapping as in roof 12; or horizontal siding with optional louvers.

Figure 2:
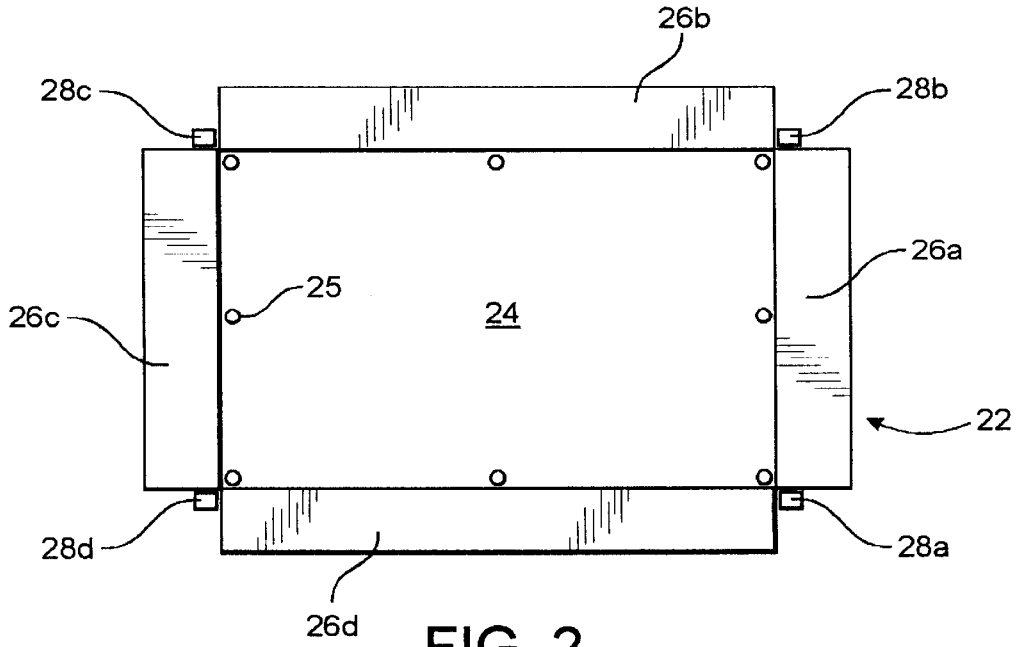
FIG. 2 shows a ground cover sheet, used for the construction of the house of FIG. 1, as it appears hen stretched out on leveled ground at the construction site.

The first stage in construction is to determine a suitable location and to clear, level and compact an area at least as large as the intended structure 10 for the construction site. Ground cover sheet 22, made of heavy gauge polyvinyl chloride plastic or any material having similar waterproof, non-biodegradable properties, is made to serve as a layout template for the construction of structure 10 as well as a sub-floor or even a primary floor covering after construction. Ground cover sheet 22 has a basic rectangular shape 24, the dimensions being the interior dimensions of structure 10. As shown in FIG. 2, ground cover sheet 22 includes rectangular flaps 26*a–d* extending from each side of basic rectangular shape 24. Ground cover sheet 22 is stretched out flat on the leveled construction site, in a selected orientation with all four flaps 26*a–d* extended. Small stakes are driven through grommeted holes 25 within basic rectangular shape 24 of ground cover sheet 22 to hold it in position for construction. The interior corners, defined by flaps 26*a*/26*b*, 26*b*/26*c*, 26*c*/26*d* & 26*d*/26*a*, provide the location coordinates for digging post holes 28*a–d* at each corner of basic rectangular shape 24 of ground cover sheet 22.

Figure 3:
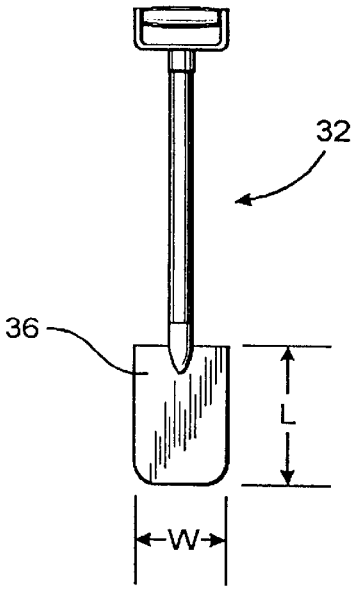
FIG. 3 shows a shovel of given blade width and length dimensions, used for construction of the house of FIG. 1.

FIG. 3 shows shovel 32 of conventional configuration, having a blade 36 of width "W" and length "L". As is described in the following, "W" and "L" are significant working dimensions for construction of structure 10. Shovel 32, in addition to its basic utility, is the means for measuring these dimensions in the construction of structure 10 according to a preferred embodiment of the present inventions. Although greater or lesser values may be assigned to "W" and "L", 200 mm and 250 mm have been used to good effect.

Figure 4:
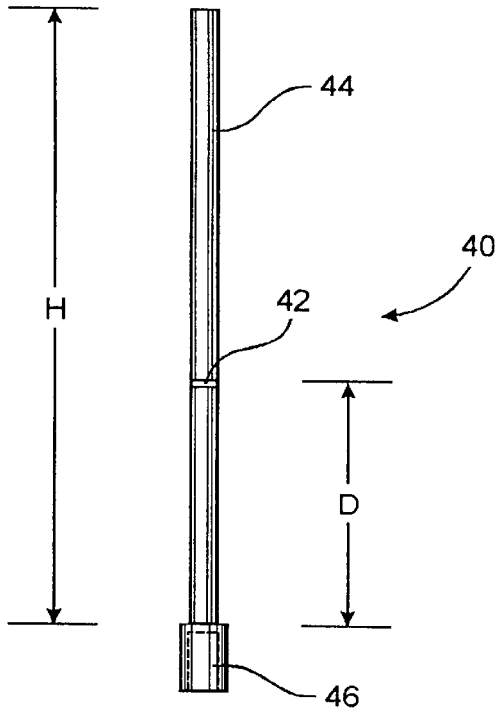
FIG. 4 shows a stake driver of given dimensions, used for construction of the house of FIG. 1.

FIG. 4 shows stake-driving tool 40, having a working depth "D" as determined by the location of ring 42 on handle 44. The working length of stake driving tool 40 is dimension "H", measured from the top end of handle 44 to the stake contacting face of steel driving cup 46. Handle 44 is conveniently made from a length of steel re-bar with steel driving cup 46 and ring 42 welded in place. As is described in the following, "H" is a significant working dimension in the construction of structure 10. Stake driving tool 40, in addition to its basic utility, is the means of measurement of these dimensions for the construction of structure 10 according to a preferred embodiment of the present inventions. Although greater or lesser values may be assigned to "H", 1,200 mm has been used to good effect.

Figure 5:
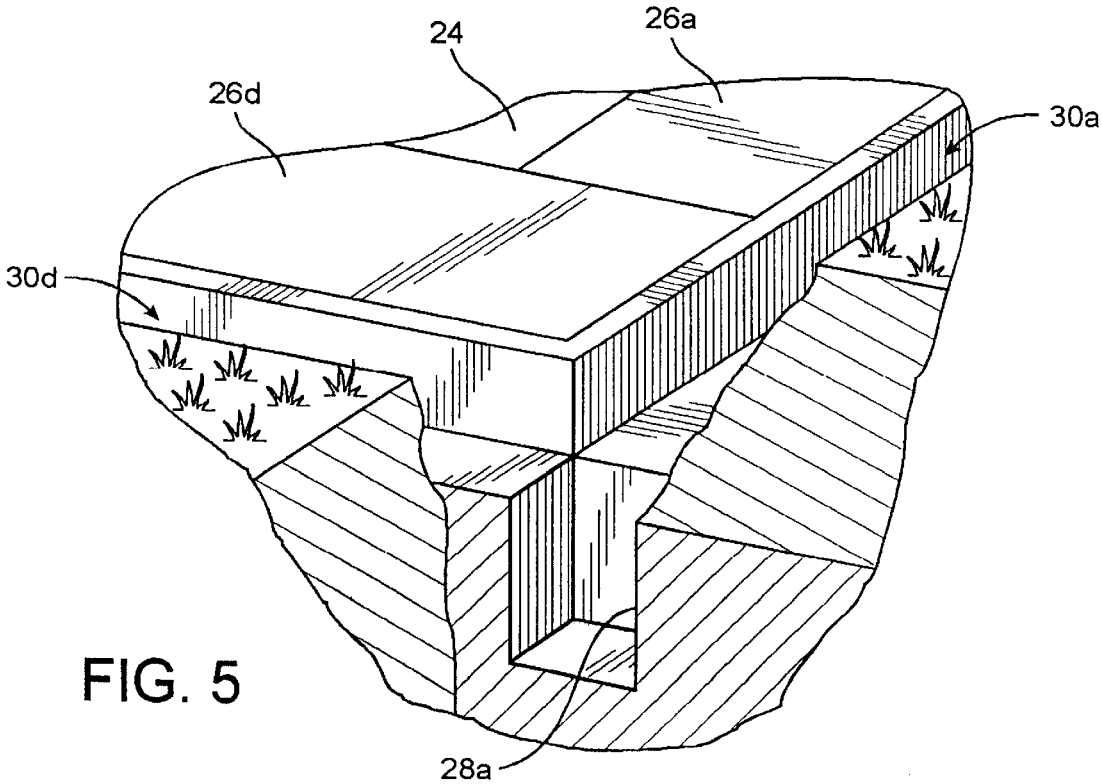
FIG. 5 shows the manner of digging a post hole and perimeter trench at a typical corner of the house of FIG. 1.

FIG. 5 is a partial section view of the construction site. After digging post holes 28*a–d*, flaps 26*a–d* are folded back to allow the digging of perimeter trenches 30*a–d* immediately adjacent to the edges of basic rectangular shape 24. A shovel 32, as shown in FIG. 3, for digging post holes 28 and perimeter trenches 30 is included with the tools and materials for structure 10. Postholes 28 preferably are dug to a depth equal to twice blade length "L" of shovel 32. The width and depth of perimeter trenches 30*a–d* are preferably made equal to blade width "W"and length "L"of shovel 32 respectively.

Figure 6:
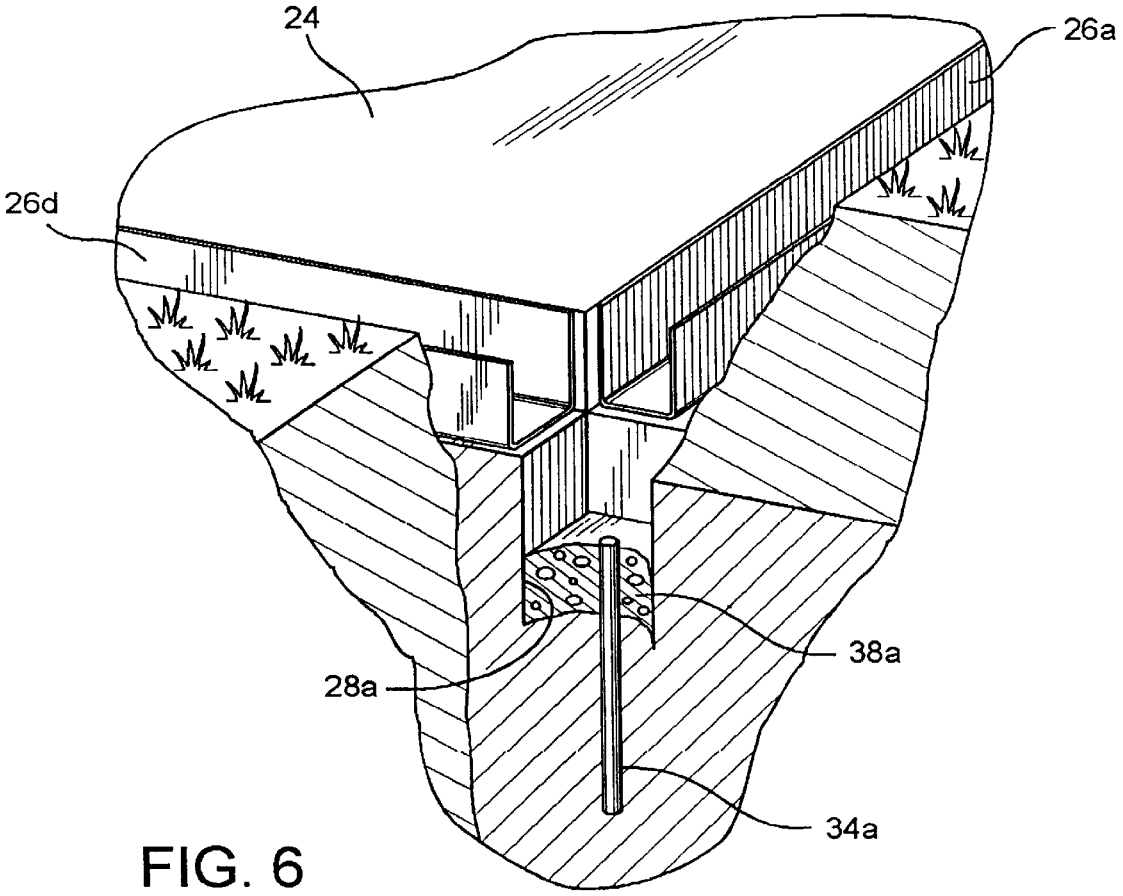
FIG. 6 shows the manner of preparation of the post hole and perimeter trench of FIG. 5 construction of the house of FIG. 1.

FIG. 6 is the same partial section view as shown in FIG. 5. Flaps 26 have again been stretched out, and then folded down, as a lining for perimeter trenches 30, as is illustrated here by flaps 26*a* and 26*d* in perimeter trenches 30*a* and 30*d* respectively. Stake bars 34*a–d* are driven into the bottoms of postholes 28*a–d* to approximately the same depth. The proper driving depth is measured by using dimension "D" of stake driving tool 40, as shown in FIG. 4, so that stake bars 34 are driven into the earth until the top of stake driving tool body 42 is approximately level with the surface of basic rectangular shape 24. The tops of stake bars 34 may be made level with respect to one another by using a plastic tube water leveling device included with the tools and materials for structure 10. Postholes 28 are then filled with a hardening or compactible material to the tops of stake bars 34 so as to provide level corner pads 38. The material of pads 38 is preferably concrete, but any earthen material, or small rocks, or mixture thereof, which may be made hard, flat and level is appropriate.

Figure 7:
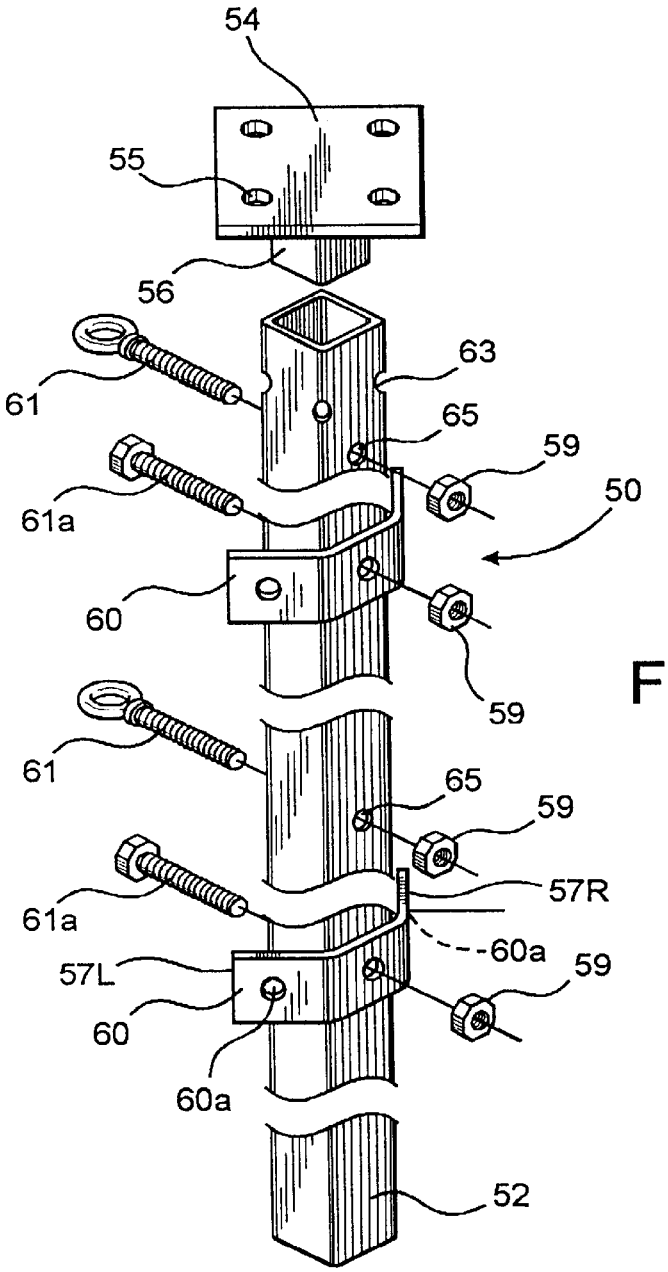
FIG. 7 is an exploded view of a typical corner post assembly for construction of the house illustrating three of the six eye-bolts of the assembly of FIG. 1.

FIG. 7 shows the design of post assembly 50, the vertical member at each corner in the structural framing of structure 10, according to this preferred embodiment. The main length of post assembly 50 is tubular post member 52, preferably provided in a 1.5" (38 mm) by 12 ga. (2.5 mm) wall, square section. Square top plate 54 is welded to plug 56, which is sized to slip into the end of tubular post member 52. It is notable that the sides of square section post member 52 are oriented at 45° to the sides of square top plate 54. Top plate 54 has four threaded holes 55, for purposes to be discussed in the following disclosures. Connecting brackets 60 are bolted against one side of tubular post member 52 by means of bolts 61*a* and nuts 59, at two locations near the ⅓ points of the length of post 50. Six eye-bolts 61 and nuts 59 are bolted to square section post member 52 in pre-drilled holes 65 to provide attaching eyes at a total of six spaced apart locations in each tubular post member 52 for suspending the wire members 80 and 106. The length of eye-bolts 61 is such that they intentionally extend approximately one bolt diameter beyond the mating threads of nuts 59. Side extensions 57R and 57L of connecting bracket 56 provide one threaded hole 60*a* at each side of tubular post member 52, for attachment of the temporary horizontal side beam 62. In the illustrated embodiment, side beams 62 are formed from two angle piers 62*a* and 62*b* fastened together. (See FIG. 12). It is notable that side extensions 57R and 57L are bent back so as to be oriented in planes that are inclined at 45° to the sides of square section post member 52. Holes 63 are formed diagonally across the corners of tubular steel member 52 for attachment of gable end beams 66.

Figure 8:
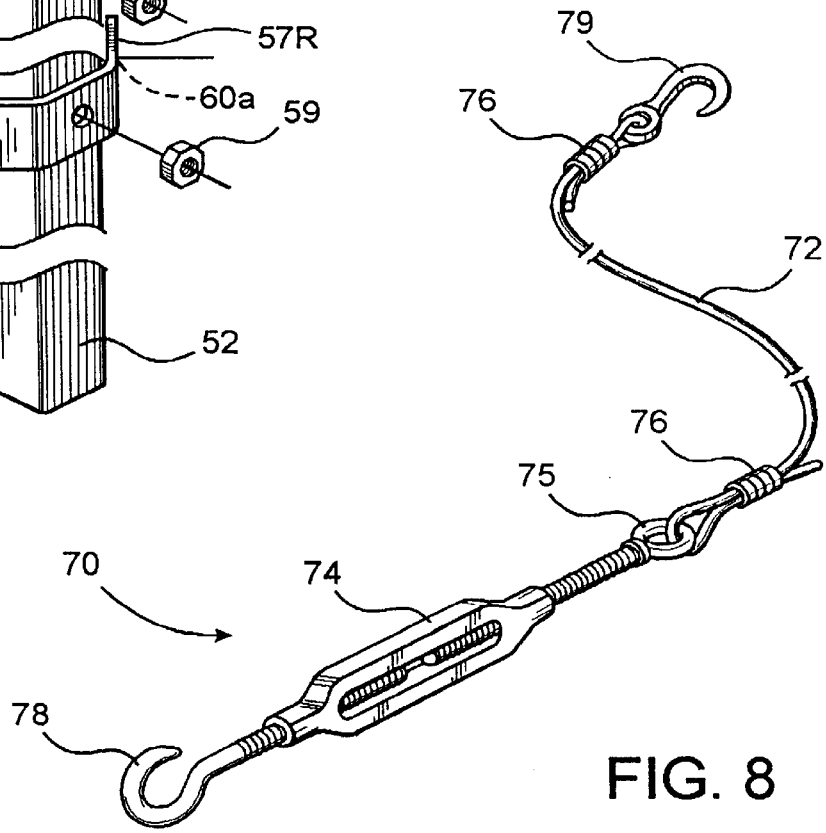
FIG. 8 shows the construction of a typical diagonal wire brace assembly for construction of the house of FIG. 1.

FIG. 8 is a view showing a typical diagonal wire brace assembly 70. Brace assembly 70 comprises turnbuckle 74 having eye 75 and hook 78. Wire member 72 is looped through eye 75 of turnbuckle 74 and joined by means of swaged collar 76. The opposite end of wire member 72 is looped through the connecting eye of hook 79 and joined in a similar manner. Diagonal wire brace assemblies 70 are made in two lengths. The length of a wire brace assembly 70S is specifically for the side walls of structure 10 and the length of a wire brace assembly 70E is for the end walls.

Figure 9:
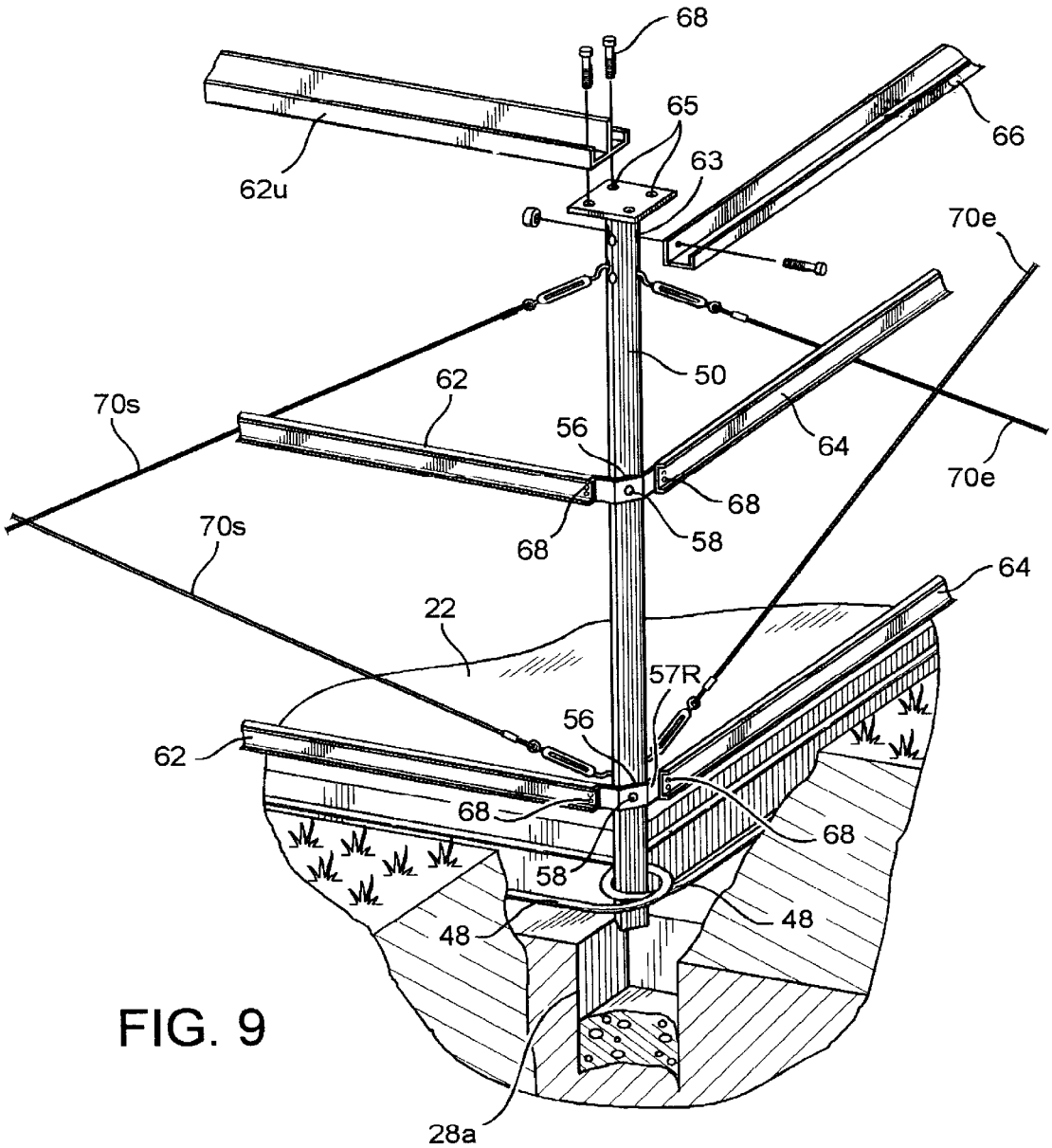
FIG. 9 shows the manner of setting corner post assemblies, the assembly of diagonal bracing, temporary horizontal members and gable end beam assemblies for construction of the house of FIG. 1.

FIG. 9 shows the manner of setting post assemblies 50 at each corner; the assembly of diagonal wire braces 70S and 70E at the sides and ends respectively of structure 10; temporary horizontal beams 62 and 64; and gable end beams 66, according to a preferred embodiment of the present inventions. Post assemblies 50 are placed vertically on top of the prepared level corner pads 38 so that top plate 54 is placed in a square relationship with the sides of rectangular ground cover sheet 22 and so that side extensions 57R and L are oriented to face the outside of the structure. Temporary horizontal beams 62 and 64 are bolted to side extensions 57R and 57L using one bolt 68 at each connection. In a similar manner, temporary upper side beams 62U and permanent gable end beams 66 are bolted to top plates 54 and post 52 respectively.

Figure 9A:
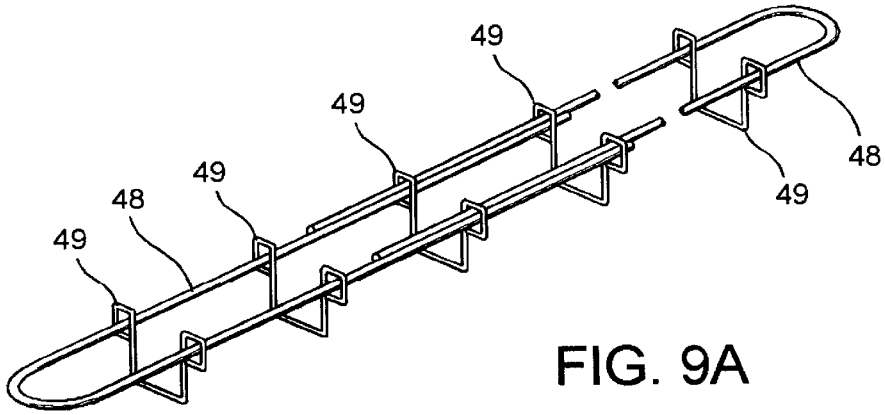
FIG. 9A shows a detail view of the reinforcing bar arrangement used in the perimeter trenches of FIG. 9.

Elongated "U" shaped re-bar members 48 are placed in perimeter trenches 30 and around post assemblies 50 at each corner, with the extended ends overlapping, as shown in FIG. 9A. A plurality of formed wire support stands 49 support re-bar members 48 and hold them in position. The "U" shaped reinforcing bars 48 are supported by wire support stands 49 so as to be elevated above the bottom of perimeter trench 30.

At this juncture, turnbuckles 74 are lengthened to permit attachment of wire brace assemblies 70S and 70E diagonally, to an upper eye-bolt 61 at one corner post 50 and a lower eye-bolt 61 at each adjacent corner post. These lengths are such that an equal length and proper tension is produced in the installation of wire brace assemblies 70S and 70E when turnbuckles 74 are fully closed. In this manner, it is assured that each side wall is square and each corner post 52 is vertical. Post holes 28*a–d* are filled to a level above reinforcing members 48 with hardening or compactible material to provide permanent retention. A measured quantity of this same fill material, sufficient to cover re-bar members 48, is placed in the bottom of each perimeter trench 30. The fill material is preferably concrete but any earthen material, or small rocks, or mixture thereof, which may be tamped down for compaction is appropriate. Before the fill material is hardened or compacted, as the case may be, turnbuckles 74 of diagonal wire brace assemblies 70S and 70E are screwed in to their closed length so as to brace the framework members of structure 10 in a properly vertical and square relationship.

Figure 10:
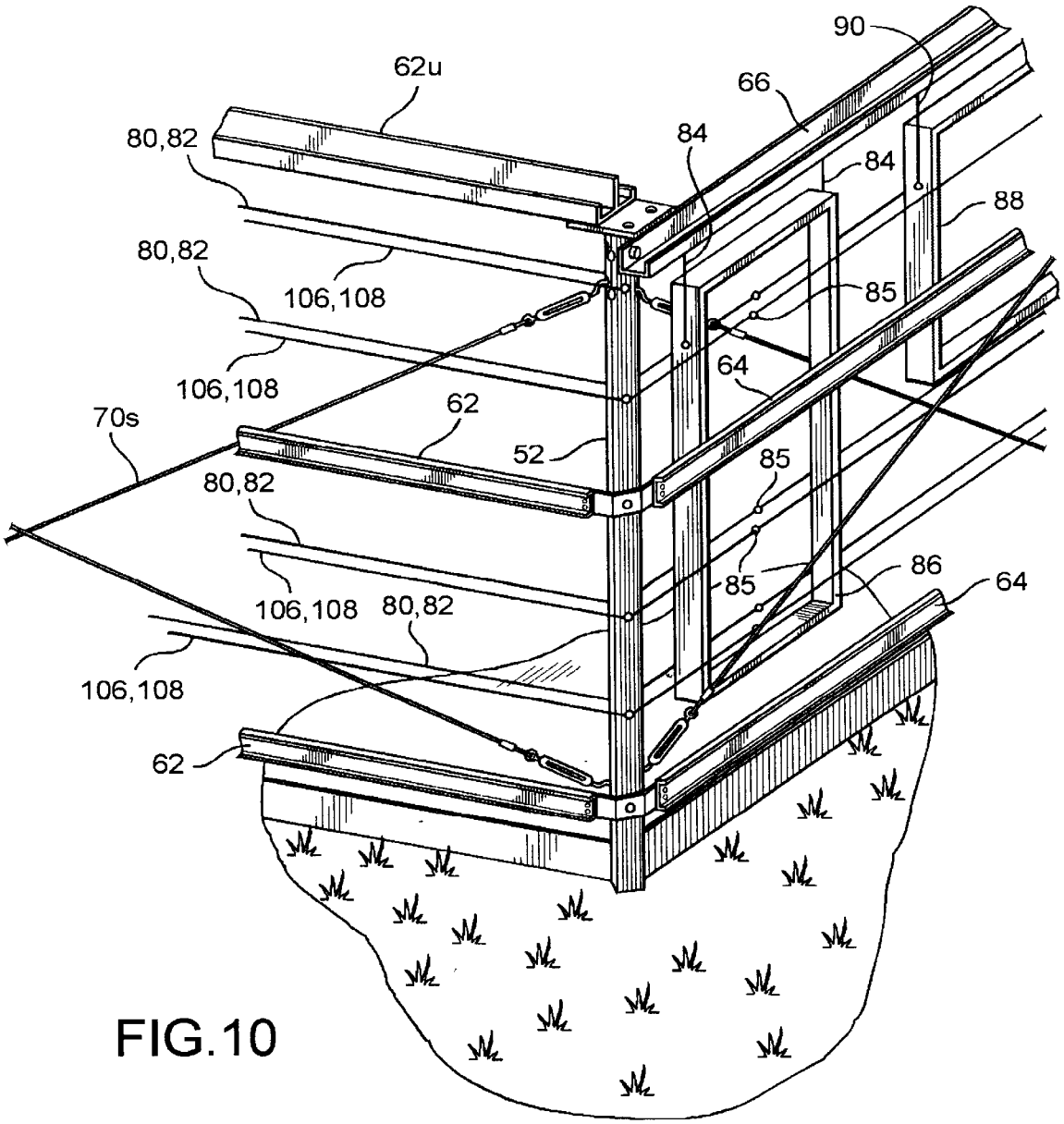
FIG. 10 shows the manner of placing horizontal wire members to define the inner wall construction surface and hanging the door and window openings for construction of the use of FIG. 1.
Figure 13:
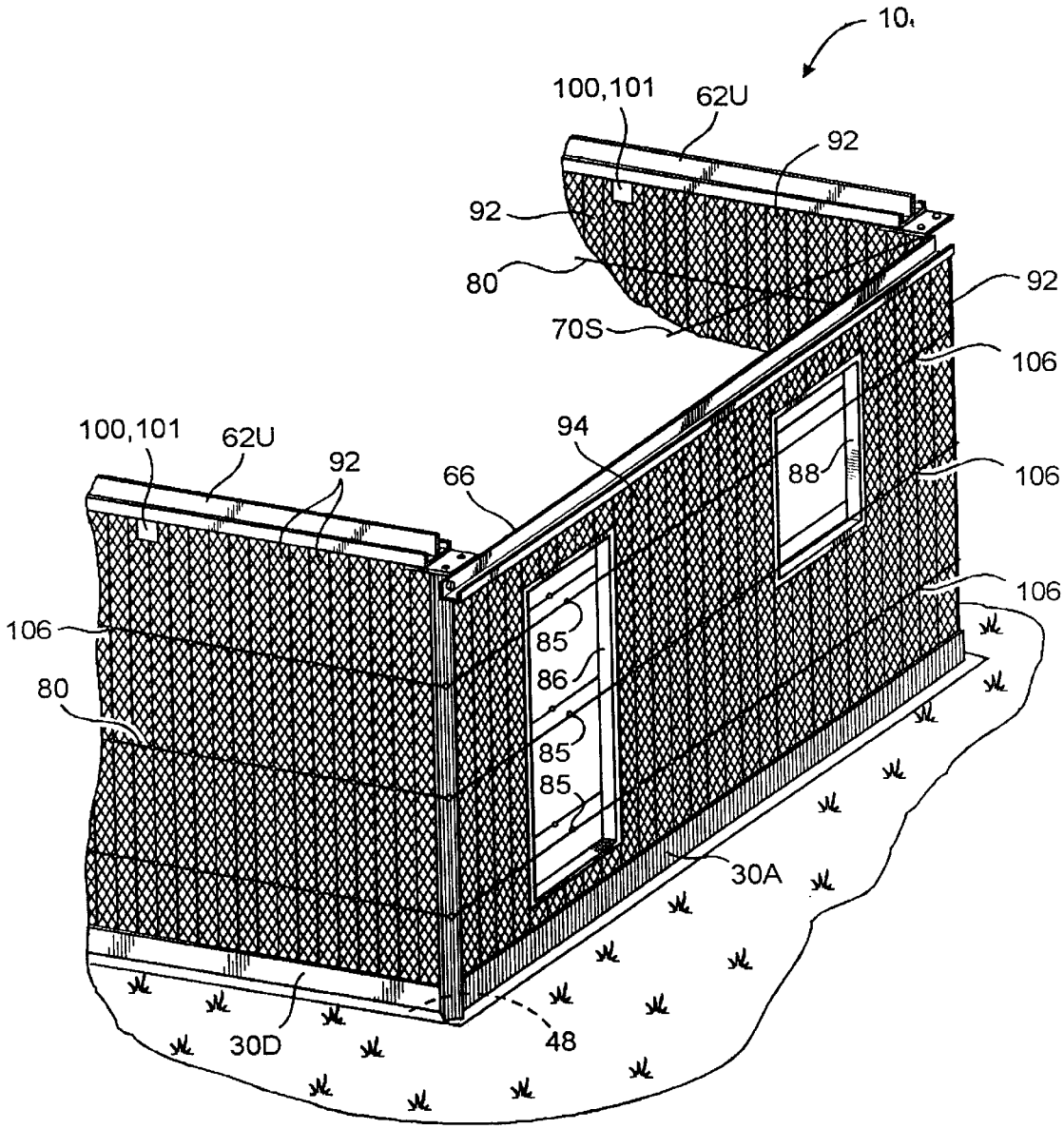
FIG. 13 shows the manner of placing vertically folded metal mesh reinforcing members and horizontal wire members and tensioners to define the outer wall construction surface construction of the house of FIG. 1.
Figure 17:
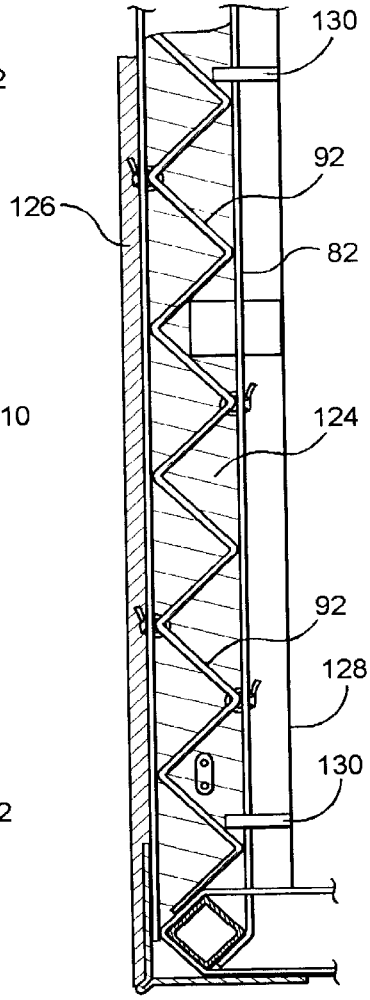
FIG. 17 is a section view of a wall constructed according to the present inventions as seen after the application of hardening filler material to the inner face of the metal mesh reinforcing members and a finished cover layer to the hardened filler material.

FIG. 10 shows the framework of structure 10 as disclosed in FIG. 9, with the addition of a plurality of rows of inside horizontal wires 80, passing through the eyes of eye-bolts 61 of post assemblies 50 so as to encircle the interior of the framework of structure 10. Inside horizontal wires 80 are tightened with ratchet rollers 85 and in this manner establish the wall construction surfaces 82 (as seen in FIGS. 15–17) for the inside of structure 10. Outside horizontal wires 106 encircling the exterior of structure 10 where they are located by the extended length of eye-bolts 61 are not installed until reinforcing panels 92 are in place. As shown in FIG. 13 door frame 86 for door 16 is hung by wires 84 of equal length from gable end beam 66 at a location established by predrilled holes. In a similar manner, window frame 88, for later installation of window 18, is hung from gable end beam 66 or horizontal upper side beam 62U by wires 90 of equal length at a location established by predrilled holes.

Figure 11:
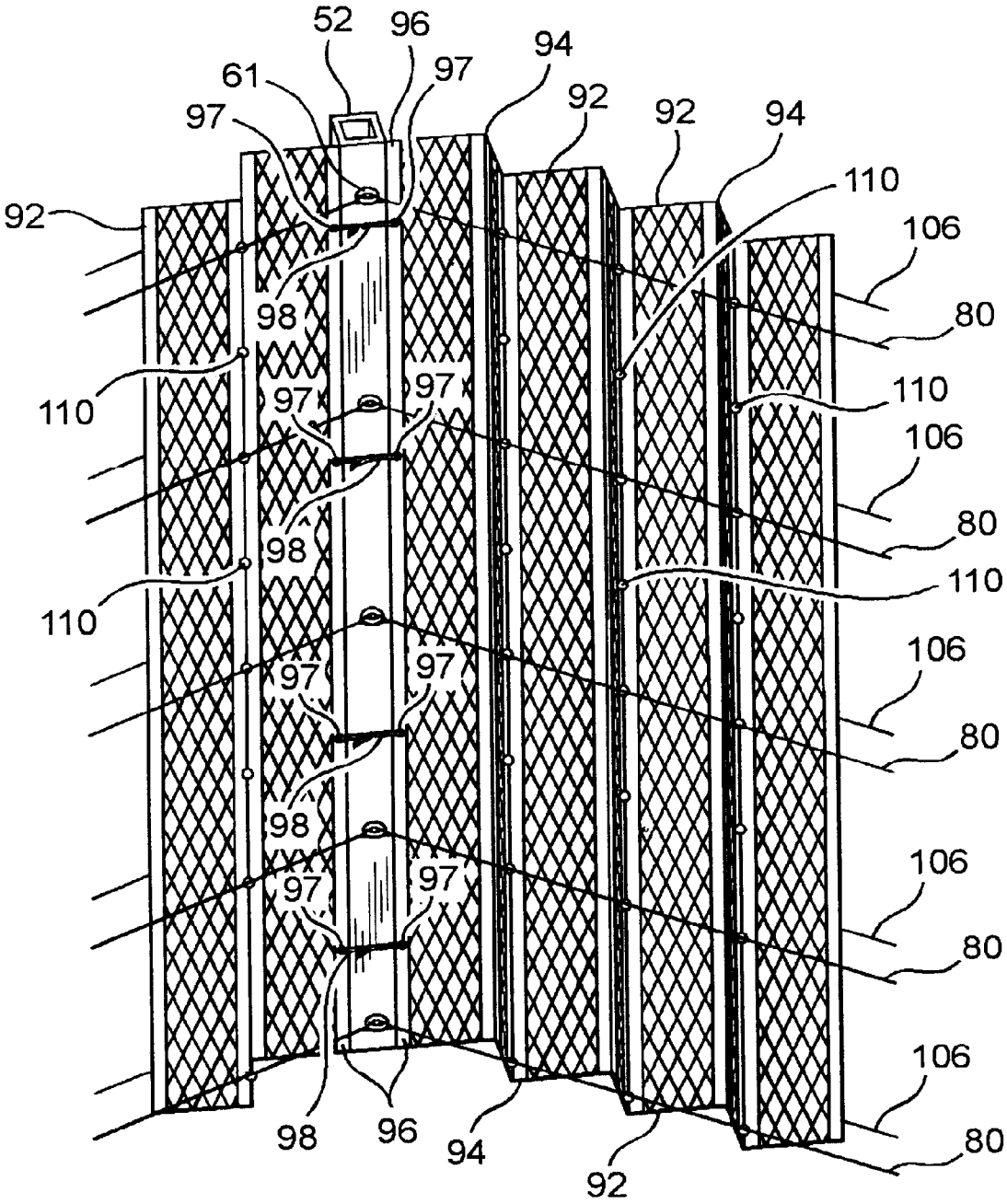
FIG. 11 shows the manner of attachment of the vertically folded metal mesh reinforcing member the corner posts for construction of the house of FIG. 1.

FIG. 11 shows the construction of reinforcing panels 92. Preferably panels 92 are formed by slitting and expanding steel sheet metal so as to provide the necessary openings for interlocking contact with concrete, clay or plaster. Vertical folds 94 impart stiffness and provide section depth, and thereby, enhance the structural reinforcement contribution of panels 92. It is preferable, but by no means essential, to have solid, unexpanded edge portions 96 of panels 92, in order to facilitate joining them together or to adjacent structure. Here, for instance, unexpanded edge portion 96 provides holes 97 for attachment of the edge of panel 92 to tubular post member 52. The ends of plastic wire ties 98 are joined and tightened after being passed around post member 52 and through holes 97. Hog rings 110 (see FIGS. 15–17), crimped together in adjacent holes 97 serve to join panels 92 together, edge-to-edge. Hog rings 110 also to hold panels 92 to inner and outer horizontal wires 80 and 106.

Figure 12:
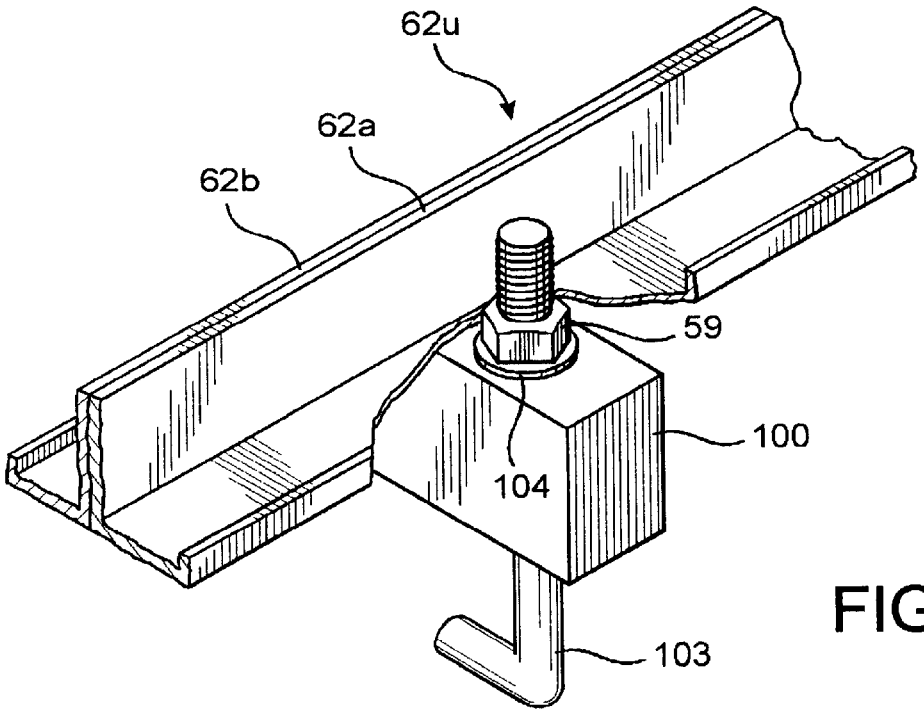
FIG. 12 shows a view of a typical block for forming a roof truss pocket for construction of the FIG. 1.
Figure 12A:
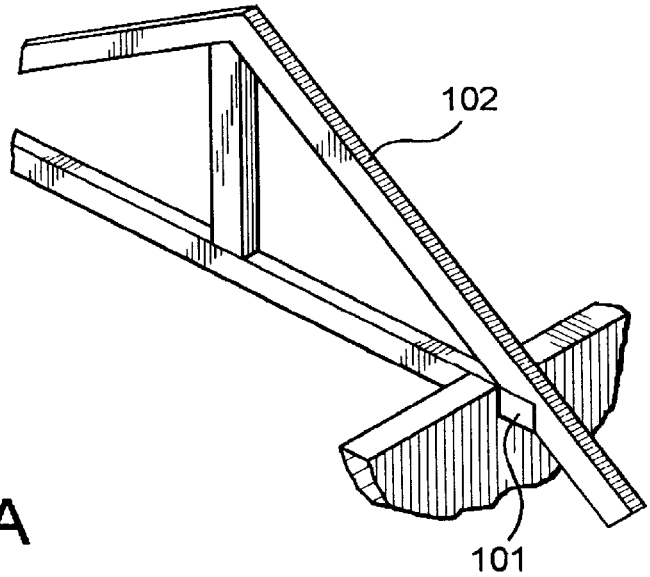
FIG. 12A shows a roof truss installed in a truss pocket.
Figure 14:
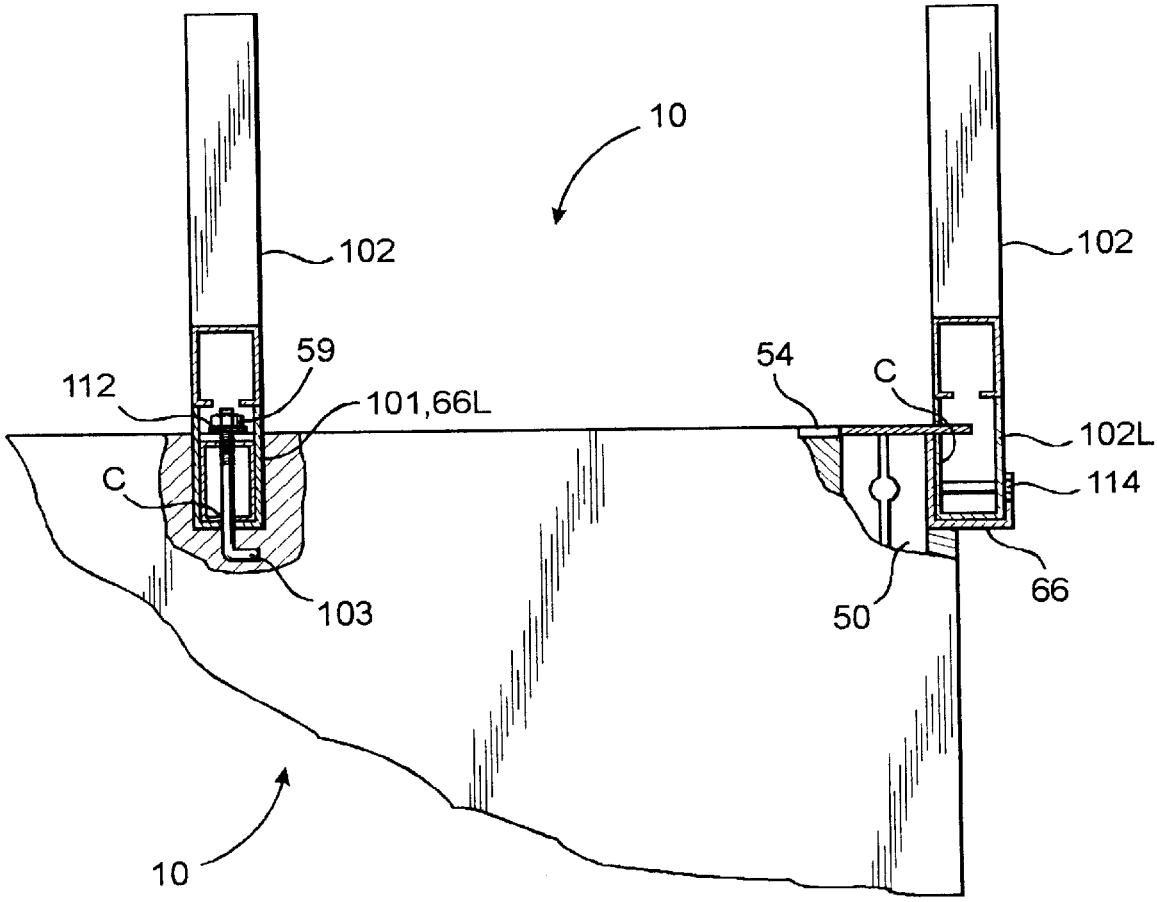
FIG. 14 shows a view of the manner of connection of roof trusses at the corner posts and at the formed pockets in walls for construction of the house of FIG. 1.

FIG. 12 shows a typical forming block 100, preferably made from styrofoam or a similar inexpensive, frangible material. Forming blocks 100 are shaped to be attached underneath temporary horizontal upper side beams 62 at spaced apart intervals where they will serve to create pockets 101 (as shown in FIGS. 13 and 14) for subsequent installation of transverse roof truss assemblies 102. Forming blocks 100 each include a "J" bolt 103 that extends through appropriately located holes "B" in the lower side of temporary side beams 62U, where it will be held in place by nut 59 and washer 104. "J" bolt 103 also extends well below the body of forming block 100 so that its "J" end will be grouted into the fill material placed beneath the formed pocket 101. In FIG. 12*a* a roof truss assembly 102 is shown mounted in a pocket 101.

FIG. 13 shows the final construction stage for the framework of structure 10. Here, is shown the placement of a continuous plurality of expanded metal mesh reinforcement panels 92 against the inside horizontal wires and around door and window frames 86 and 88. The lower ends of reinforcement panels 92 rest on cement in each perimeter trench 30*a*, 30*d*, etc. between reinforcing bars 48, and the upper ends extend to temporary upper side beam 62*u*. Outside horizontal wires 106 are stretched around the framework of structure 10 and tightened with ratchet rollers 85, thereby establishing the outside wall construction surfaces 108 of structure 10, and temporary horizontal beams 62 and 64 are removed. Hog-rings 110 (seen FIGS. 15–17) are passed through openings in the mesh of panels 92 at the apex of vertical folds 94 and closed over the adjacent inside horizontal wire 80 or outside horizontal wire 106, as applicable. Perimeter trenches 30 are filled with hardening or campactible material to ground level. Also seen in this view are forming blocks 100, attached to the underside of temporary side beam 62 with gaps in metal mesh reinforcement panels 92 clipped out to allow formation of pockets 101.

FIG. 14 is a partial side view of the framework of structure 10, showing details of the installation of a truss assembly 102 in a pocket 101 and to post assembly 50. Frangible forming block 100 has been broken away from "J" bolt 103, clearing pocket 101 to receive lower beam member 66L of a truss assembly 66. "J" bolt 103 passes through a clearance hole "C" in lower beam member 66L and extends above that member by approximately two bolt diameters in order to receive keeper plate 112 and nut 59. Tightening nut 59 on "J" bolt 103 to bear on keeper plate 112 holds truss assembly 102 firmly in position.

For the connection of end truss assembly 102 to post assembly 50 a gable end beam 66 is provided to support the end truss assembly 102. Bolts 114 can pass through clearance hole "C" in the truss assembly 102 and be threaded into the beam 66. Tightening bolt 114 then holds end truss assembly 102 firmly in place as the gable end of structure 10.

FIGS. 15, 16 and 17 are cross-section views showing stages in the construction of a typical wall according to a preferred embodiment of the present inventions. FIG. 15 shows inside horizontal wires 80, which establish inside wall construction surface 82, as they are attached to reinforcing panels 92 by hog-rings 110. In a like manner, outside horizontal wires 106, which establish outside wall construction surface 108, are also shown attached to reinforcing panels 92 by hogrings 110. Expanded metal corner members 116 are attached over tubular corner members 52 to provide for attachment of a finishing layer 126 of hardening material over outside wall construction surface 82 as shown in FIG. 16. It is preferable that the framework of structure 10, particularly the expanded metal mesh components 92 and 116, be coated with a material such as screed binder, commercially available from TAL, Ltd., Kempton Park, South Africa, to improve the bond of the filler material and to reduce corrosion of reinforcing panels 92. Such coating may be applied by brush or spray according to the available facilities and should be done at this stage, before the work of FIG. 16 is undertaken.

Figure 18:
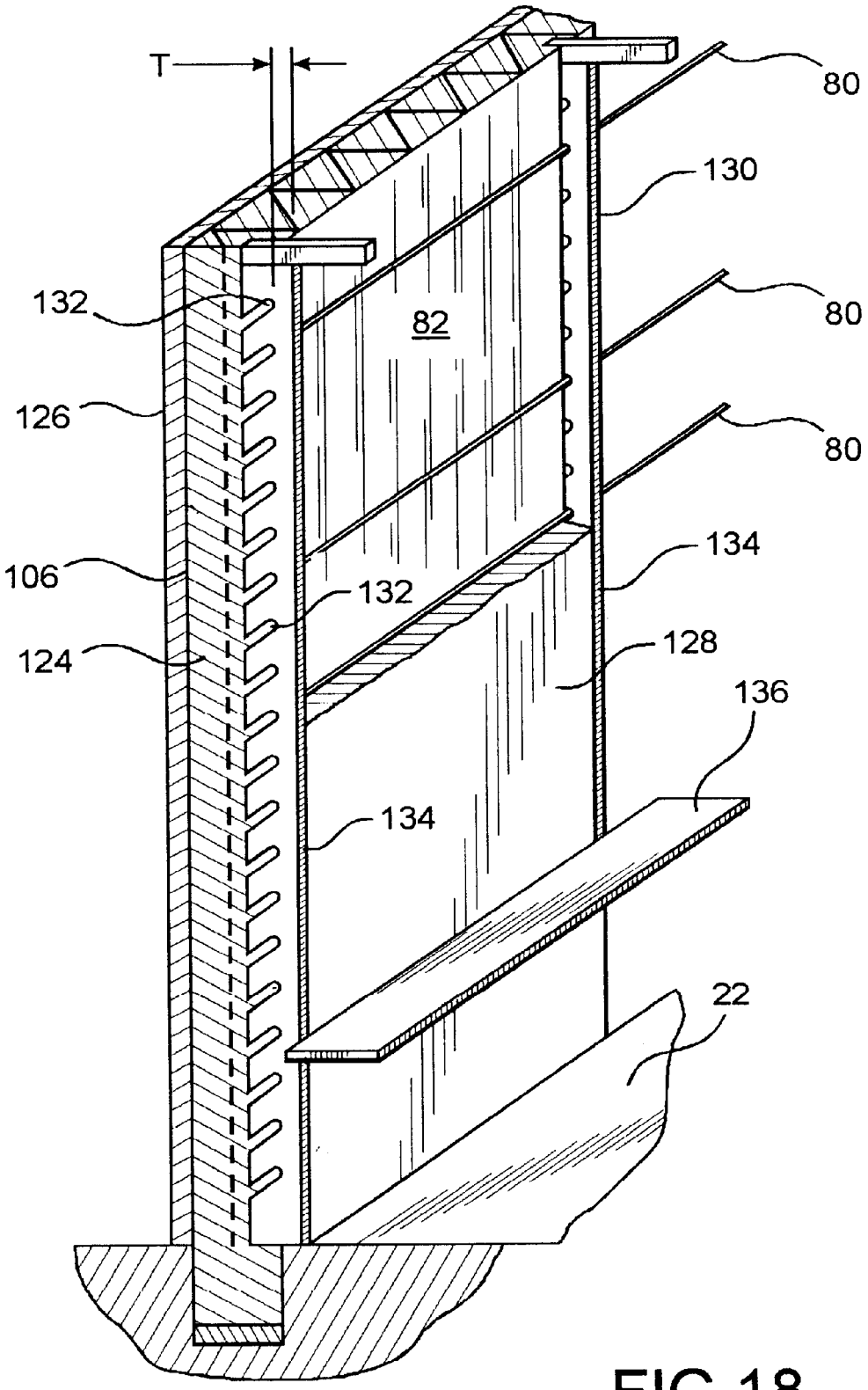
FIG. 18 is a wall section view showing the use of two temporary guides which may be placed on the horizontal wires of the inner and outer construction surfaces to facilitate application of a uniform finished cover layer to the hardening filler material.

In FIG. 16, utility services, comprising electrical wiring 118, switches 120 and pipes 122 for plumbing are shown placed in vertical folds 94 of panels 92, so as to be set within the inside construction surface 82. A hardening filler material 124, preferably a cementitious material, is applied to the outer surfaces of reinforcing panels 92, penetrating the mesh openings for an interlocking attachment. Filler material 124 is added until the build-up reaches more-or-less to the level of outside wall construction surface 108. When this build-up is in place, plastering tools 130 are placed over outside horizontal wires 106, as shown in FIG. 18, spaced apart approximately one meter. Thus positioned, plastering guide tools 130 provide guiding edges for application of a finishing layer 126 of hardening material over outside wall construction surface 108. Finishing layer 126 covers hogrings 110 and provides a smooth, attractive appearance. As finishing layer 126 is applied to each meter wide panel, the remote plastering guide tool is withdrawn and advanced to be used for finishing the next adjacent panel. The narrow gaps left by the removal of plastering guide tools 130 are filled and smoothed as a last step.

FIG. 17 shows the similar application of filler material 124 to the inner surface of reinforcing panels 92, reaching more or less to the level of inside wall construction surface 82. Plastering guide tools 130 are used in the same manner for application of finishing layer 128 to the interior walls of structure 10 however, for cosmetic purposes, a finer grade of plaster may be used indoors and care must be taken in working around window and door frames 88 and 86, as are shown in FIGS. 10 and 13.

FIG. 18 shows plastering guide tools 130 and the manner of using these tools to apply finishing layers 126 and 128 of hardening material. The notches 132 along one edge of guide tool 130 go over outside horizontal wires 106 or inside horizontal wires 80. Guide tool 130 is pushed into filler material 124 and will stop its penetration when said wires "bottom out" in notches 132. The dimension "T" from the bottom of notches 132 to the back edge 134 of guide tool 130 determines the thickness of finishing layers 126 and 128. Starting at ground cover sheet 22 and working upwards, material is applied to inside wall construction surface 82 to and beyond the level of back edge 134, which then serves as a guide for straight edge 136, for wiping across the material as a screed, scraping off the excess and filling in the low places. Straight edge 136 may be a board or any straight piece longer than the spacing between plastering guide tools 130.

The restrictive description and drawings of the specific examples above do not point out what an infringement of this patent would be, but are to provide at least one explanation of how to use and make the inventions. The limits of the inventions and the bounds of the patent protection are measured by and defined in the following claims.

What is claimed is:

1. A method for building a rectangular structure comprising the steps of:

leveling a ground area at least as large as the intended structure;

stretching a generally rectangular shaped sheet of material on the leveled ground area, the dimensions of said sheet corresponding to the dimensions of said structure;

vertically setting posts adjacent to each corner of said sheet, so that the outside of said posts establishes outside wall construction surfaces and the inside of said posts establishes inside wall construction surfaces for said structure;

connecting beams to the tops of posts;

suspending a plurality of inside e wire members from said posts to extend horizontally from said inside of said posts, to define said inside wall construction surfaces;

suspending a plurality of outside wire members horizontally from said outside of said posts, to define said outside wall construction surfaces;

placing a reinforcing structure of vertically folded metal mesh members between said inside and outside horizontal wire members, while providing for door and window openings;

applying a hardening material to said metal mesh members so as to fill the space remaining between said inside and outside wall construction surface to form wall structures;

placing a plurality of first form blocks spaced apart on the underside of one of said beams, before placement of said folded metal mesh members placing a plurality of second form blocks spaced apart on the underside of a second beam located on the opposite side of said structure from said first form blocks, said first and second form blocks being shaped and positioned to create roof beam receiving first and second pockets respectively;

removing said beams and said form blocks after the application of hardening material to said metal mesh members; and installing roof supporting beams fitting into and extending said first pockets to said second pockets.

2. The method of claim 1 wherein the step of setting posts vertically further comprises:

digging post holes outside of and immediately adjacent to each corner of said sheet; and filling said post holes around said posts so as to hold said posts in their respective vertical positions.

3. The method of claim 1 and further comprising the steps of:

digging a trench immediately adjacent each edge of said sheet; and extending said reinforcing structure of vertically folded metal mesh members into said trench.

4. The method of claim 1 wherein the step of setting posts vertically further comprises:

connecting tensionable connecting members between attachments proximate the lower end of each post and the upper end of each adjacent post; and applying tension to said tensionable connecting members so as to hold said posts in their respective vertical positions.

5. The method of claim 1 wherein the step of installing a covered roof structure further comprises installing roof trusses.

6. The method of claim 2 wherein the step of setting posts vertically further comprises:

digging said post holes to a given depth;

driving bars vertically into the bottom of each said post hole so that the tops of said bars are uniformly positioned at a set horizontal level below the surface of said rectangular ground cover sheet;

filling said post holes with a hardening material to the level of the tops of said bars and allowing said hardening material to set; and placing said posts in said post holes, on top of said bars and filling said post holes around said posts so as to hold said posts in a vertical position.

7. The method of claim 3 and further comprising the step of unfolding an extension of said sheet to line the sides and bottom of said trench.

8. The method of claim 3 and further comprising the steps of:

unfolding an extension of said sheet to line the sides and bottom of said trench;

placing reinforcing material in said trench; and filling said trench with hardening material after placement of said metal mesh reinforcing structure within said trench.

9. The method of claim 4 wherein the step of installing roof supporting beams further comprises installing roof trusses.

10. The method of claim 1 additionally comprising the step of forming a floor on said sheet from hardening material.

11. Apparatus for building the framework of a rectangular structure comprising:

a sheet of material of the dimensions of the internal dimensions of said intended structure;

post assemblies for embedment in the ground at each corner of said rectangular structure, with inwardly and outwardly facing sides, at locations determined by said rectangular dimensions;

beam members for upper and lower horizontal connection between adjacent said post members to fix the spacing therebetween;

diagonal brace members of predetermined length for upper and lower connection between said adjacent said post assemblies;

a plurality of wire members for horizontal connection across similarly oriented sides of said adjacent said post members so as to establish inside and outside wall construction surfaces;

a plurality of expanded metal wall reinforcement members for placement in a substantially continuous array between said inside and outside wall construction surfaces;

a plurality of first form blocks disposed on the underside of one of said beam members and a plurality of second form blocks disposed on the underside of another, opposing one of said beam members;

said first and said second form blocks structured to be removable after the application of a hardening material to said expanded metal wall reinforcement members; and roof supporting beams supporting beams structured to be disposed into pockets defined by said removed first and second form blocks.

12. Apparatus for building the framework of a house according to claim 11 wherein said post assemblies further comprise upper and lower diagonal brace connections.

13. Apparatus for building the framework of a rectangular structure according to claim 11 wherein said diagonal brace members further comprise fully closed turnbuckle assemblies.

14. Apparatus for building the framework of a rectangular structure according to claim 11 wherein said beam members further comprise:

two temporary lower side beam members, two temporary upper side beam members, two temporary lower end beam members and two upper end beam members; and roof truss members joined to said end beam members to provide two end truss assemblies.

15. An assembly of components for on-site construction of the framework of a walled house comprising:

a rectangular sheet of waterproof material, the rectangular dimensions of said sheet being the internal dimensions of said intended house and further serving to locate post holes at each corner of the construction site;

post assemblies for embedment in said post holes at a predetermined depth, with inwardly and outwardly facing sides, said posts having a length corresponding to the height of the walls of the house;

beam members for upper and lower horizontal connection between adjacent said post members to fix the spacing therebetween, said beam member being of a length corresponding to the length of the walls;

diagonal brace members of predetermined length for upper and lower connection between said adjacent said post assemblies;

a plurality of wire members for horizontal connection across similarly oriented sides of said adjacent said post members so as to establish inside and outside wall construction surfaces;

a plurality of expanded metal wall reinforcement members for placement in a substantially continuous array between said inside and outside wall construction surfaces;

a plurality of first form blocks disposed on the underside of one of said beam members and a plurality of second form blocks disposed on the underside of another, opposing one of said beam members;

said first and said second form blocks structured to be removable after the application of a hardening material to said expanded metal wall reinforcement members; and roof supporting beams supporting beams structured to be disposed into pockets defined by said removed first and second form blocks.

16. The assembly of claim 15 further comprising:

a shovel having a blade of predetermined length for measurement of digging depth for said corner post holes; and a stake driving tool having a body of predetermined length for measurement of the ground embedment depth of said post assemblies.

17. A method for framing square and vertical walls in a rectangular structure comprising the steps of:

providing a level, rectangular floor;

erecting four corner members, one at each corner of said rectangular floor, with the lower ends of said corner members being spaced apart and constrained to a rectangular pattern of predetermined length and width dimensions, said corner members having upper ends extending to a uniform height above said rectangular floor;

joining adjacent corner member upper ends with horizontal members so that said upper ends are spaced apart by said predetermined length and width dimensions, said horizontal members being parallel to the plane of said rectangular floor;

connecting diagonal members between each said corner member upper end and the adjacent corner member lower ends, the length of said diagonal members being selected to enforce a 90° angle between each said corner member and the horizontal members connected thereto and thereby provide framing for four square and vertical walls in a rectangular structure;

placing a plurality of removable first form blocks spaced apart on the underside of one said horizontal member;

attaching a plurality of removable second form blocks spaced apart on the underside of the opposite said horizontal member and opposite to said first form blocks, said first and second form blocks being shaped and positioned to create roof beam receiving first and second pockets respectively;

filling the square and vertical wall framing with hardening wall structure material;

removing said horizontal members with the attached first and second form blocks after said hardening material hardens; and installing roof supporting beams fitting into and extending from said first pockets to said second pockets.

18. The method of claim 17 wherein the step of erecting four corner members further comprises:

digging holes to a depth equal to twice the length of the blade of a given shovel;

driving bars vertically into the bottom of each said hole so that the tops of said bars are uniformly positioned one blade length of said shovel below the surface of said level, rectangular floor;

filling said holes with a hardening material to the level of the tops of said bars and allowing said hardening material to set; and placing said corner members in said holes, on top of said bars and filling said holes around said corner members so as to hold them in a more-or-less vertical position.

19. The method of claim 17 wherein the step of erecting corner members further comprises:

digging corner holes outside of and immediately adjacent to each corner of said level, rectangular floor; and filling said corner holes around said corner members so as to hold said corner members in their respective positions.

20. The method of claim 17 and further comprising the steps of:

digging a trench immediately adjacent each side of said level, rectangular floor, said trench being of a width equal to the blade width of a given shovel and of a depth equal to the blade length of said shovel and connecting with said corner member holes.

21. The method of claim 17 wherein said diagonal members further comprise expandable turnbuckles and the selected length of said diagonal member is determined with said turnbuckle in the fully closed position.

22. A method for building a structure on a ground surface comprising the steps of:

setting structural members into the ground surface so that the outside of said structural members establish outside wall construction surfaces and the inside of said structural members establish inside wall construction surfaces for the structure;

connecting beams to said structural members;

suspending a plurality of inside wire members from said structural members to extend between said structural members to define said inside wall construction surfaces;

suspending a plurality of outside wire members from said structural members to extend between said structural members to define said outside wall construction surfaces;

placing metal mesh members between said inside wire members and said outside wire members;

applying a hardening material to said metal mesh members so as to fill the space between said inside and said outside wall construction surfaces to form wall structures;

placing a plurality of first form blocks spaced apart on the underside of one of said beams, before placement of said metal mesh members;

placing a plurality of second form blocks spaced apart on the underside of a second beam located on the opposite side of said structure from said first form blocks, said first and second form blocks being shaped and positioned to create roof beam receiving first and second pockets respectively;

removing said beams and said form blocks after the application of said hardening material to said metal mesh members; and installing roof supporting beams fitting into and extending said first pockets to said second pockets.

23. The method of claim 22 further comprising the step of:

leveling a ground area on the ground surface at least as large as the intended structure; and supplying a floor covering.

24. The method of claim 23 wherein the step of supplying a floor covering comprises:

stretching a generally rectangular shaped sheet corresponding to the intended dimensions of the structure.

25. The method of claim 22 wherein said structural members comprise vertical setting posts.

26. The method of claim 25 wherein said vertical setting posts are placed adjacent to each corner of said sheet.

27. The method of claim 22 further comprising the step of connecting beams to the tops of said structural members.

28. The method of claim 22 further comprising the step of providing for door and window openings in said metal mesh members.

29. The method of claim 26 further comprising the step of installing a covered roof structure.

30. An apparatus for building the framework of a rectangular structure comprising:

a sheet of material of the dimensions of the internal dimensions of said intended structure;

post assemblies for embedment in the ground at each corner of said rectangular structure, with inwardly and outwardly facing sides, at locations determined by said rectangular dimensions;

beam members for upper and lower horizontal connection between adjacent said post members to fix the spacing therebetween;

diagonal brace members of predetermined length for upper and lower connection between said adjacent said post assemblies;

a plurality of wire members for horizontal connection across similarly oriented sides of said adjacent said post members so as to establish inside and outside wall construction surfaces; and a plurality of expanded metal wall reinforcement members for placement in a substantially continuous array between said inside and outside wall construction surfaces;

said sheet of material further including a plurality of extensions disposed at each edge thereof, said extensions structured to extend into a trench formed between adjacent ones of said post members, a plurality of first form blocks disposed on the underside of one of said beam members and a plurality of second form blocks disposed on the underside of another, opposing one of said beam members, said first and said second form blocks structured to be removable after the application of a hardening material to said expanded metal wall reinforcement members; and roof supporting beams supporting beams structured to be disposed into pockets defined by said removed first and second form blocks.

31. An assembly of components for on-site construction of the framework of a walled house comprising:

post assemblies for embedment in each of a plurality of post holes at a predetermined depth, with inwardly and outwardly facing sides, said posts having a length corresponding to the height of the walls of the house;

beam members for upper and lower horizontal connection between adjacent said post members to fix the spacing therebetween, said beam member being of a length corresponding to the length of the walls;

diagonal brace members of predetermined length for upper and lower connection between said adjacent said post assemblies;

a plurality of wire members for horizontal connection across similarly oriented sides of said adjacent said post members so as to establish inside and outside wall construction surfaces;

a plurality of expanded metal wall reinforcement members for placement in a substantially continuous array between said inside and outside wall construction surfaces;

said reinforcement members structured to extend into a trench disposed between adjacent ones of said post assemblies;

a plurality of temporary horizontal side beams extending between adjacent ones of said post assemblies;

a plurality of connecting brackets secured to said post assemblies and structured to secure said temporary horizontal side beams thereto;

a quantity of a hardening material disposed on said reinforcement members;

a plurality of first form blocks disposed on the underside of one of said beam members and a plurality of second form blocks disposed on the underside of another, opposing one of said beam members, said first and said second form blocks structured to be removable after the application of said hardening material to said expanded metal wall reinforcement members; and roof supporting beams supporting beams structured to be disposed into pockets defined by said removed first and second form blocks.

32. An assembly of components for on-site construction of the framework of a walled house comprising:

post assemblies for embedment in each of a plurality of post holes at a predetermined depth, with inwardly and outwardly facing sides, said posts having a length corresponding to the height of the walls of the house;

beam members for upper and lower horizontal connection between adjacent said post members to fix the spacing therebetween, said beam member being of a length corresponding to the length of the walls;

diagonal brace members of predetermined length for upper and lower connection between said adjacent said post assemblies;

a plurality of wire members for horizontal connection across similarly oriented sides of said adjacent said post members so as to establish inside and outside wall construction surfaces;

a plurality of expanded metal wall reinforcement panels for placement in a substantially continuous array between said inside and outside wall construction surfaces;

said reinforcement panels structured to extend into a trench disposed between adjacent ones of said post assemblies;

a plurality of hog rings disposed between adjacent ones of said reinforcement panels and structured to secure said reinforcement panels with one another;

a quantity of a hardening material disposed on said reinforcement panels;

a plurality of first form blocks disposed on the underside of one of said beam members and a plurality of second form blocks disposed on the underside of another, opposing one of said beam members, said first and said second form blocks structured to be removable after the application of said hardening material to said expanded metal wall reinforcement members; and roof supporting beams supporting beams structured to be disposed into pockets defined by said removed first and second form blocks.

* * * * *